United States Patent [19]

Christensen et al.

[11] 4,348,715

[45] Sep. 7, 1982

[54] LIGHTED TOOL HOLDER

[76] Inventors: Leonard R. Christensen, 4205 Fullerton Ave., Chicago, Ill. 60639; Hiroshi Horibata, Takane-So, 29-18, 5-Chome, Kamirenjaku, Mitaka-Shi, Tokyo, Japan

[21] Appl. No.: 111,841

[22] Filed: Jan. 14, 1980

[51] Int. Cl.[3] ..... F21V 33/00

[52] U.S. Cl. ..... 362/109; 362/119; 362/120; 362/202; 362/203; 362/205

[58] Field of Search ..... 362/109, 119, 120, 202, 362/203, 205

[56] References Cited

U.S. PATENT DOCUMENTS 2,773,974 12/1956 Markett ..... 362/120

3,603,782 9/1971 Wortmann ..... 362/120

*Primary Examiner*—Stephen J. Lechert, Jr.

[57] ABSTRACT

A lighted tool holder for releasably holding a variety of tools, such as screw drivers, including an elongated hand-held hollow body having a centrally mounted light bulb therein with plural batteries axially shiftable into electrical contact with the bulb. The batteries and light bulb are held in position by a single spring wire spiraled around the base of the light bulb and surrounding the batteries and engaging one of the battery grounds to provide the ground wire circuit for battery actuation.

The releasable tool is rigidly held in position by a cylindrical adapter mounted in the working end of the tool holder body. This adapter has integral frusto-conical segmented base members, fixed within the hollow body to support the adapter and also permit light to pass through the adapter where it is diffused by reflectors and passed through a cup-like lens on the end of the tool holder body which provides edge lighting.

In another embodiment dual light bulbs are provided supported partly on a U-shaped bracket extending through the tool adapter into the battery compartment of the body where it is selectively engaged by the axially shiftable batteries to provide electrical contact between the batteries and the light bulbs.

15 Claims, 22 Drawing Figures

Fig. 1
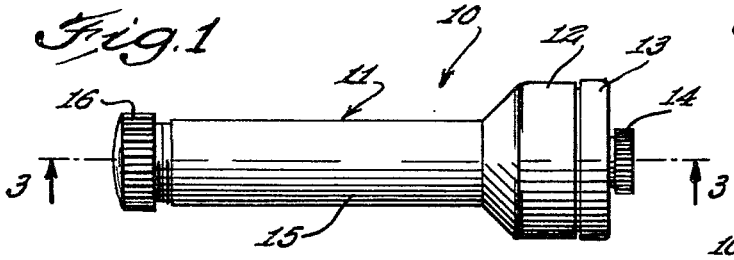
Fig. 2
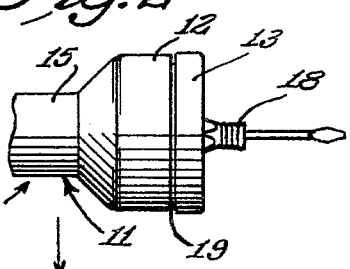
Fig. 3
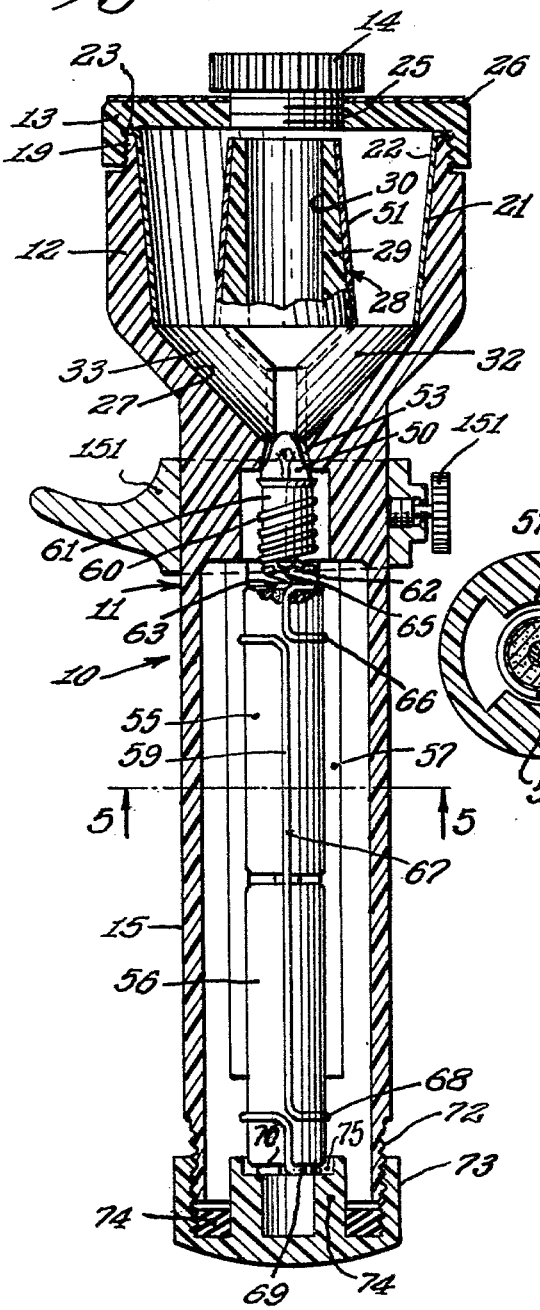
Fig. 6
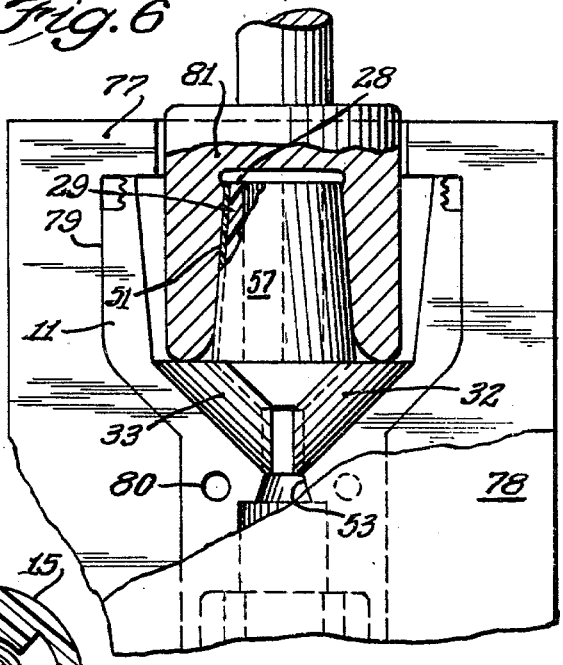
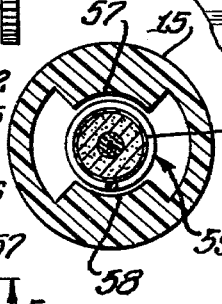
Fig. 5
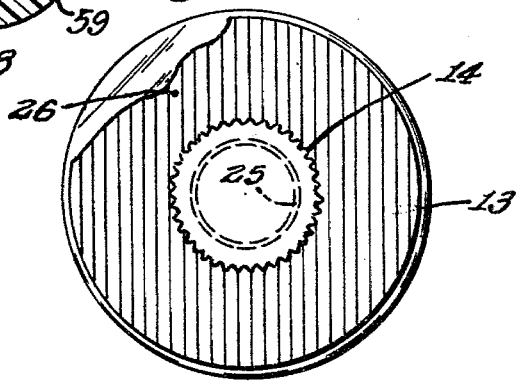
Fig. 4

171
172
165
162
175
174
170
161
160
166
163
169
168
162
174
160
163
163
161
170

LIGHTED TOOL HOLDER

BACKGROUND OF THE PRESENT INVENTION

Over the past decade lighted tool holders for conventional hand-held tools have found increasing popularity. In addition to providing greater effective length for the tool, they illuminate the work area for working in less than adequately lighted areas, and they provide additional torque for turning the tool. These lighted tool holders have found popularity for supporting torque tools such as screwdrivers and also for supporting non-torque tools such as casting, spinning, fly and still fishing rods, being particularly useful for night fishing.

These prior lighted tool holders have conventionally included one or more bulbs mounted in an offset position within an enlarged head in a hollow tool holder body. A tool receiving adapter is mounted centrally between the bulbs and is rigidly fixed in the hollow body. One or more batteries are also conventionally mounted within the hollow body beneath the tool adapter and they provide a source of power for the light bulbs either with an external thumb latch switch on the side of the body or a rotary threaded switch on the end of the tool body that shifts the batteries axially to effect bulb energization.

It is the primary object of the present invention to provide an improved releasable tool lighted holder of the type described generally above.

SUMMARY OF THE PRESENT INVENTION

In accordance with the present invention a lighted tool holder is provided for releasably holding a variety of tools in which the ground wiring between the batteries and the light bulb is substantially eliminated and in which light is diffused through a tool supporting adapter to eliminate any direct light passing through the tool holder lens.

Toward this end the present lighted tool holder includes an elongated holder body having a hollow battery case at one end and an enlarged head at the other end covered by a clear plastic cup-like lens that provides edge lighting for the tool holder. A generally tubular tool adapter is mounted centrally in the enlarged head of the holder body and has an opening that receives and grips the handle of a tool or fishing rod. This adapter has a plurality of spaced, segmented frusto-conical base projections that are fixed within a complementary surface in the tool body to both radially and axially fix the tool adapter in the body in an improved manner over prior constructions.

A bulb is mounted centrally in the holder body beneath the adapter so that light from the bulb passes through the segmented frusto-conical base of the tool adapter where it is reflected in the enlarged head of the tool body by reflective surfaces on the interior thereof and the exterior of a tubular portion of the adapter providing completely reflected and diffused light through the lens. This eliminates the harshness and brightness of conventional lighted tool holders that have the bulb mounted above the base of the adapter adjacent to the lens.

The elimination of the conventional ground wire between the bulb and the batteries is provided by a one piece spring holder for the batteries and the bulb. This holder is constructed of electrical conducting spring wire that has an upper sprial portion threadedly received on the bulb base to support the bulb and provide an electrical ground therefor. A second spiral portion of the wire holder extends between the bulb and the batteries to provide the spring force for normally urging one of the battery's contact out of engagement with the bulb contact. Another portion of this wire holder surrounds and encompasses the plural batteries to hold them together in the proper position in the hollow body; and a fourth portion of this wire extends under the lower-most battery and engages its ground surface to provide the necessary grounding between the batteries and the bulb. Thus, a single wire holder assembly provides the four functions of holding the light bulb, all of the batteries, urging the batteries out of contact with the light bulb and also providing the necessary ground wire between the bulb and the batteries.

In another embodiment of the present invention dual light bulbs are supported in an improved manner to eliminate the conventional contact wiring between the bulbs and the batteries. In this embodiment a U-shaped bracket extends through and is held by a split sleeve in the adapter assembly. The bight portion of this U-shaped bracket is located in axial alignment with the battery contact of the uppermost battery for selective engagement therewith. The upper portions of the legs of the bracket extend within the enlarged head of the holder body and assists in supporting the bulbs by engagement with the bulb contacts. In this way the bracket provides the necessary electrical connection between the light bulbs and the batteries through the adapter in a very simplified fashion.

BRIEF DESCRIPTION OF THE DRAWINGS

FIG. 1 is a plan view of the present lighted tool holder with a seal plug mounted in the covering lens;

FIG. 2 is a fragmentary plan view of the tool holder shown in FIG. 1 with the plug removed and a screw driver mounted therein;

FIG. 3 is an enlarged cross-section taken generally along line 3—3 of FIG. 1;

FIG. 4 is a top view of the tool holder shown in FIG. 3 with a portion of a filter broken away;

FIG. 5 is a cross-section taken generally along line 5—5 of FIG. 3 showing the battery and bulb holder;

FIG. 6 is a fragmentary view, partly in section, illustrating an assembly jig for the tool holder and a pressing tool for one of the reflectors in the tool holder;

DETAILED DESCRIPTION OF THE PREFERRED EMBODIMENTS

Figure 12:
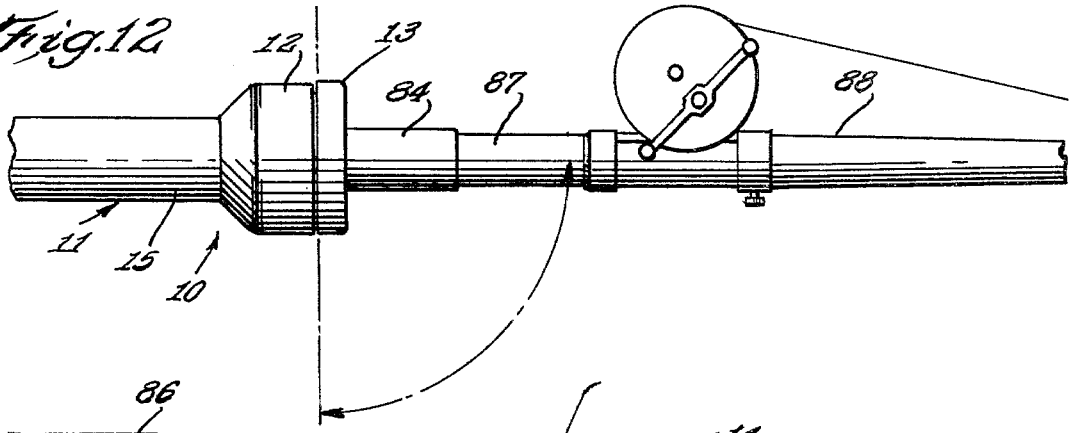
FIG. 12 is a fragmentary view of the tool holder shown in FIG. 3 with the adapter of FIGS. 10 and 11 holding a still fishing rod.

Referring to the drawings and particularly FIGS. 1 to 5, a lighted tool holder 10 is illustrated having a hollow body 11 with an enlarged head portion 12 enclosed by a covering lens 13 and seal cap 14, and a reduced tubular handle portion 15 closed by an end cap 16 threaded thereto. FIG. 2 illustrates the lighted tool holder 10 with seal cap 14 removed and a screw driver 18 inserted into the holder in preparation for use.

The tool holder 10 accommodates a wide variety of tools, including the screw driver 18 as well as other conventional hand-held tools and many types of fishing rods.

Viewing FIG. 2 the holder body 11 is seen to have an upper externally threaded end portion 19 threadedly receiving lens 13 and a slightly tapered frusto-conical interior surface 21 that receives a complementary reflector 22 having a radially outwardly extending upper annular lip 23 clamped between lens 13 and the end of the enlarged head portion 12.

The covering lens 13 is constructed of clear plastic and is a cup shaped member having internal threads mating with the threads on body portion 19. The lens 13, because of its cup-like configuration, provides edge lighting, or radially diffused light from the present tool holder, and also seals the internal parts of the tool holder from dust and other foreign material with the sealing cap 14 threaded into central opening 25 in the lens. A removable transparent plastic colored filter 26 engages the surface of the lens and is held in position by plug 14. This may be a red filter which permits the tool holder to be used as a warning light when desired.

The interior of the holder body 12 includes a second steeper frusto-conical surface 27 contiguous with surface 23 that receives and holds a tool adapter member or assembly 28. The tool adapter 28 includes a central downwardly and outwardly tapered tubular portion 29 with a hexagonal opening 30 adapted to receive and hold the handle of a tool.

Figure 7:
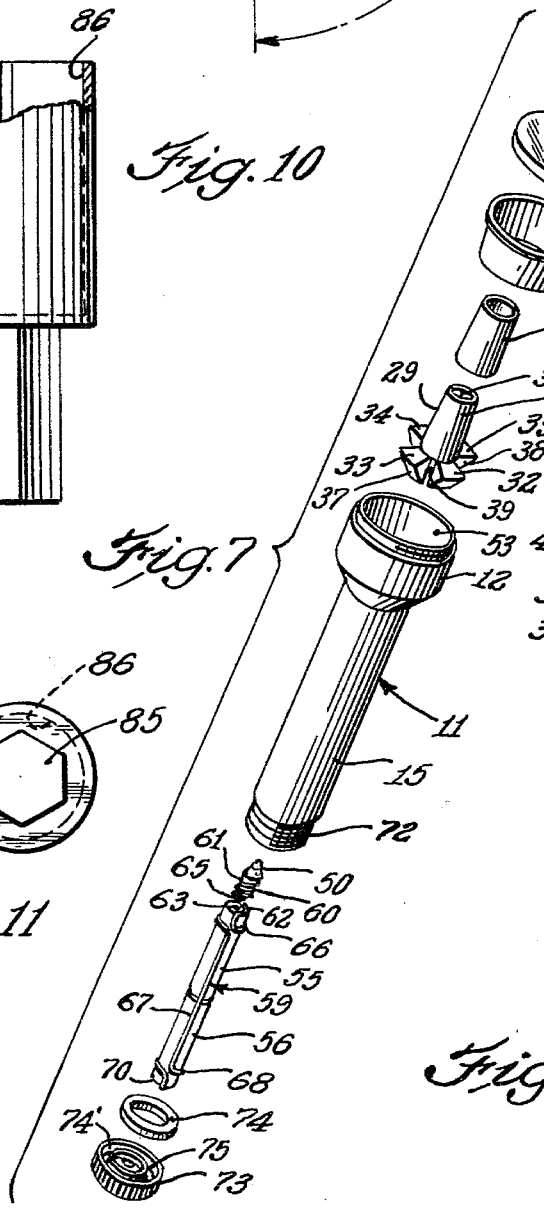
FIG. 7 is an exploded view of the tool holder shown in FIG. 3.
Figure 8:
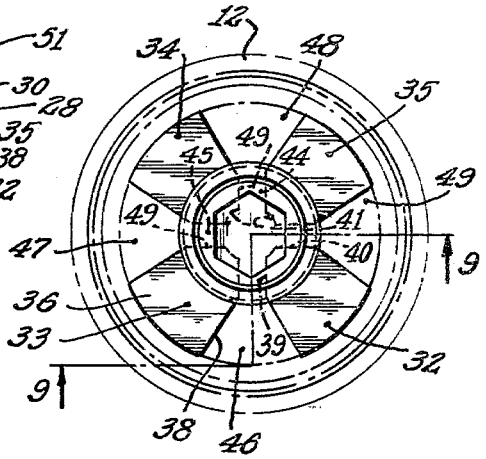
FIG. 8 is a top elevation of the tool adapter subassembly shown in FIG. 3.
Figure 9:
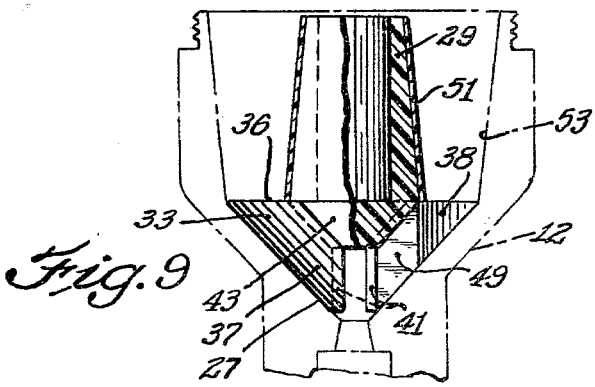
FIG. 9 is a side view, partly in section, of the tool adapter shown in FIG. 8.

As seen clearly in the exploded view of FIG. 7, the adapter 28 has four frusto-conical, spaced segments 32, 33, 34 and 35 at its base. Each of these segments, as seen in FIGS. 8 and 9, includes a radially extending surface 36 perpendicular to the axis of the adapter, a frusto-conical surface 37 contiguous with body surface 27, axially extending side surfaces 38 parallel, but spaced, from the axis of the adapter, converging inner surfaces 39 and 40 also parallel to but spaced from the axis of the adapter, and inner semi-cylindrical surface 41 scribed on a radius about the axis of the adapter. Surfaces 41 form a circular opening and with opening 30 in portion 29 provides an opening completely axially through the adapter. Surfaces 39 and 40 on all the segments 32, 33, 34 and 35 form perpendicularly related slots 44 and 45 through the base of the adapter. Slots 44 and 45 along with the spaces 46, 47, 48 and 49 between the segments 32 to 35 permit light from bulb 50 to pass freely through the adapter into the interior of the enlarged head 12 of the body 11. This light is reflected between the reflectors 22 and 51 and directed outwardly through the lens 13 without any direct or unreflected light being transmitted.

The frusto-conical surfaces 37 on each of the segments 32 to 35 are bonded or welded to the complementary surface 27 in the body head 12. The segmental projections 32 to 35 rigidly lock the adapter 28 in the body both radially as well as axially and because of their frusto-conical configuration also provide excellent resistance to torque on the adapter 28 imposed by the tool.

The upper portion 29 of the adapter 28 has a frusto-conical reflector 51 fixed thereto.

The body 11 has a narrow annular, slightly tapered opening 53 contiguous with conical surface 27 that receives the glass portion of the conventional flashlight type bulb 50.

Power is supplied to the bulb 50 by two flashlight type batteries 55 and 56 mounted in handle portion 15 of the body. As seen in FIG. 5 the handle portion 15 of the body has axially extending integral lugs 57 and 58 that restrain lateral movement of the batteries 55 and 56 although they are slightly spaced from the batteries as seen in this cross-section.

A holder wire 59 is provided for holding the batteries and the bulb 50 and also providing the ground connection between the bulb and the batteries. Toward this end holding wire 59 is spring tempered and includes an upper spiral portion 60 threaded on the conventional threads on base 61 of bulb 50 to assist in holding the bulb in its proper position and also provides electrical contact with the base of the bulb. Spiral portion 60 is contiguous with a second spiral portion 62 that normally urges the batteries 55 and 56, and particularly contact 63 on battery 55, out of electrical contact with contact 65 on the bottom of bulb 50. Spiral portion 62 continues into an annular segment 66 which surrounds and grips battery 55 and into axially extending portion 67 and a second annual portion 68 that surrounds and grips battery 56. Portion 68 continues into a radially inwardly extending circular portion 69 that engages ground end 70 on battery 56.

The lower portion of the handle portion 55 is threaded at 72 and receives a cup-like end cap 73 having a central annular projection 74 with a counterbored recess 75 at the upper end thereof that receives holding wire projection 69. An annual sealing washer 74 surrounds the plug 74 and seals the cap 73 against body portion 55 providing a hermetic water-tight seal for the battery case portion of the present tool holder.

When cap 73 is threaded upwardly from its position shown in FIG. 3, projection 74 thereon will shift the batteries 55 and 56 upwardly compressing holding wire spring portion 62 engaging battery contact 63 with bulb contact 62 energizing bulb 50 with the holding wire 59 providing the ground connection between the bulb 50 and the battery ground 70.

As seen in FIG. 6 an assembly jig for the present tool holders is illustrated consisting of jig halves 77 and 78 having cavities 79 for receiving the halves of the body 11. One-half of the body 11 is shown with locating pins 80 for aligning the mating halves of the body. A cup-like pressing tool 81 is illustrated for pressing reflector 51 on the upper portion 29 of the adaptor 28 with a force fit. Alternatively, the reflectors 22 and 51 may be replaced with reflective surfaces applied to the members by metal deposition processes.

Figure 10:
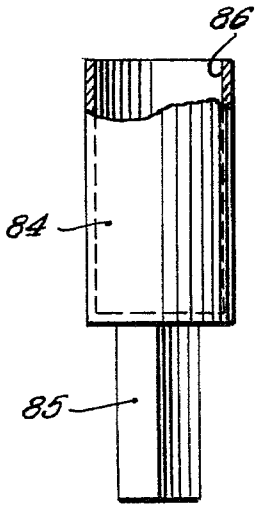
FIG. 10 is a plan view, partly in section, of a supplementary fishing rod adapter.
Figure 11:
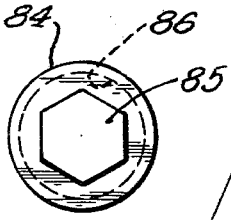
FIG. 11 is a bottom view of the adapter shown in FIG. 10.

As seen in FIGS. 10 and 11 a secondary female adapter 84 is provided with a hexagonal shank 85 and an annular female bore 86. Shank 85 is adapted to fit into adaptor opening 30 as shown in FIG. 12 and annular opening 86 is adapted to receive a cylindrical handle 87 of a conventional casting rod 88 to accommodate tool handles having different configurations. With a casting rod it is not necessary to have the same torquing capabilities as it is with a screw driver.

Another embodiment of the present invention is illustrated in FIGS. 13 to 19 wherein a lighted tool holder 90 is illustrated differing basically from the embodiment of FIGS. 1 to 9 in the provision of dual light bulbs 89 and 91 positioned above a tool adapter 92 rather than below the tool adapter as in FIGS. 1 to 9.

In this embodiment a holder body 93 includes an enlarged head portion 94 enclosed by a cup shaped clear plastic lens 95 and a hollow reduced handle portion 96 enclosed by an end cap 97 defining a battery case 99. The lens 95 is selectively closed with a sealing cap 100 that is removable in a similar fashion to cap 14 for the purpose of inserting a tool into adapter 92.

The enlarged head 94 of the body 93 has a cup-like plate 101 mounted therein with apertures 102 and 103 therein that threadedly receive the bases of both bulbs 89 and 91 to hold the bulbs in the proper positions. Plate 101 is bonded to the interior of enlarged head portion 114 and has a frusto-conical reflector 105 seated therein having an outwardly extending top lip 106 clamped between the lens 95 and the end of enlarged body head portion 94.

Figures 13, 14, 15, 16, 17, 18, 19:
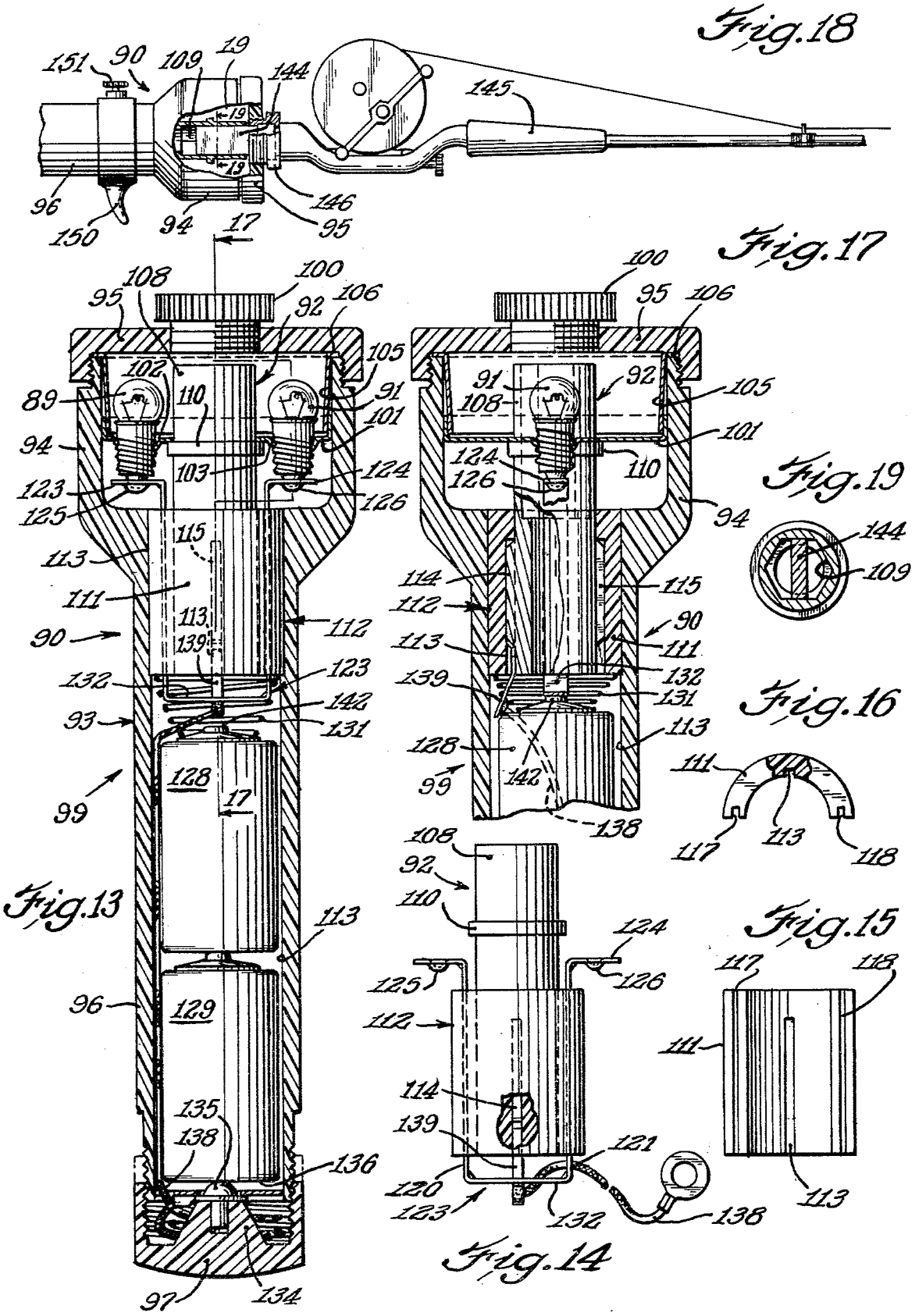
FIG. 13 is a cross-section of another embodiment of a tool holder according to the present invention with two bulbs.
FIG. 14 is a subassembly view of the adapter in the embodiment shown in FIG. 13.
FIG. 15 is a plan view of one-half of a split sleeve in the adapter assembly of FIG. 14.
FIG. 16 is a top view, partly in section, of the split sleeve part of FIG. 15.
FIG. 17 is a fragmentary cross-section taken generally along line 17—17 of FIG. 13.
FIG. 18 is a fragmentary plan view of the holding FIG. 13 with a casting rod.
FIG. 19 is a fragmentary section taken generally along line 19—19 of FIG. 18.

As seen clearly in the sub-assembly views of FIGS. 14, 15 and 16, the adapter 92 includes a central tubular member 108 having an hexagonal opening 109 (FIG. 19) for receiving and holding the shank of a tool or fishing rod in rotational locking fashion. Tubular portion 108 has an annular shoulder 110 that abuts the bottom surface of bulb plate 101 and assists in supporting the plate and the bulbs within the enlarged head 94 of the housing.

The tubular member 108 is held in position by two semi-cylindrical sleeve halves 111 (FIGS. 15 and 16) of a split sleeve assembly 112. The split sleeve 112 is welded into body bore 113. The split halves 111 have axial recesses 113 that receive ribs 114 and 115 (FIG. 17) on the tubular member 108 preventing rotation of the tubular member with respect to the split sleeve 112, thus securely locking the adapter in position in the body 94. The ends of the halves 111 of the split sleeve 112 have slots 117 and 118 that receive and clamp leg portions 120 and 121 of a generally U-shaped bulb bracket 123. The upper portions of legs 120 and 121 have outwardly extending flanges 123 and 124 having semi-spherical recesses 125 and 126 that receive the contacts of the bulbs 89 and 91. In this manner the lower portions of the bulbs are accurately located and the bracket, constructed of elecrtrically conductive metal, serves to conduct current from batteries 128 and 129 to the bulbs through the adapter 92 in a very simplified fashion.

Batteries 128 and 129 are mounted in the lower end of bore 113 in handle portion 96 of body 93 for limited axial sliding movement. A coil spring 131 reacts against the lower end of adapter 92 and the upper end of battery 128 to normally resiliently urge the batteries away from contact with "bight" portion 132 of U-shaped bracket 123.

Cap 97 closes the lower end of body portion 96 and has a central upwardly extending projection 134 with a spherically headed pin 135 pressed centrally therein that has electrical and physical contact with ground 136 on the bottom of battery 129. A ground wire 138, of the burgular alarm type, is connected to pin 135 at one end and to a ground lead 139 at the other end as seen in FIG. 17 that is welded within a recess 113 on adapter sleeve 112. The adapter 92 is conductive as is plate 101 having contact with the bases of the bulbs 89 and 91 providing the proper ground from the bulbs to the ground 136 on battery 129.

Upon upward rotation of the end cap 97, the batteries 128 and 129 will be shifted upwardly engaging battery contact 142 on battery 128 with the bight portion 132 of the conducting U-shaped bracket 123 closing the circuit between the batteries and the bulbs 89 and 91 thereby energizing the bulbs.

As seen in FIG. 18, a casting rod may be inserted into holder 90 by removing sealing cap 100 and inserting flat handle portion 144 of casting rod 145 into hexagonal opening 109 in the adaptor as shown clearly in FIG. 19. A threaded annular locking nut 146 is provided surrounding handle portion 144 and threaded into lens 95 to retain the fishing rod 145 in the proper axial position with respect to the holder 90.

A removable annular thumb or finger rest 150 is provided surrounding body portion 96 and it has a threaded member 151 extending therethrough to clamp the finger/thumb rest 150 to the tool body in removable fashion.

Figures 20, 21, 22:
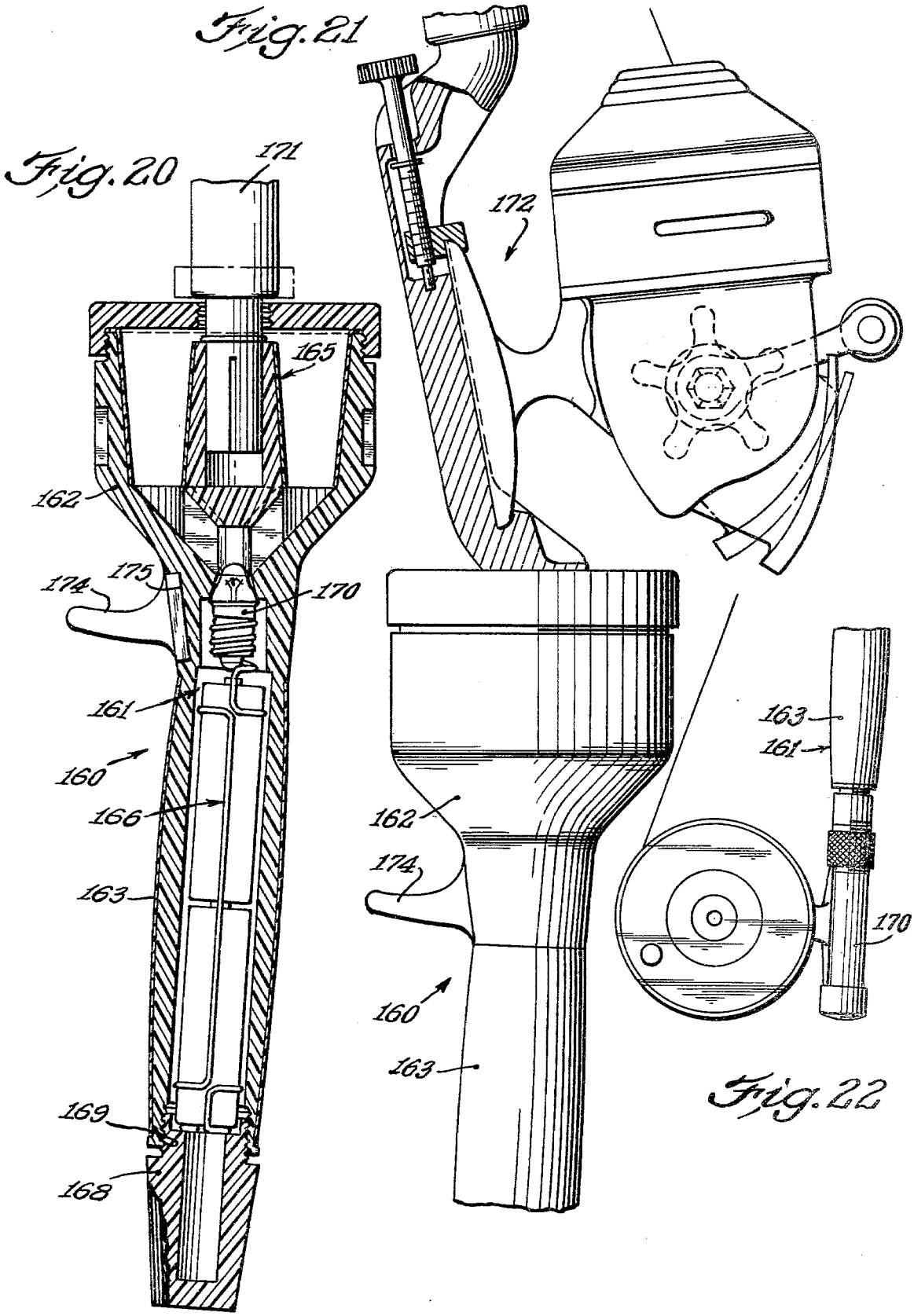
FIG. 20 is a cross-section of another embodiment of the present invention substantially the same as the embodiment shown in FIGS. 1 through 5 with the handle of a still fishing rod inserted into the holder.
FIG. 21 is a fragmentary view of the tool holder shown in FIG. 20 with a spin casting rod held therein.
FIG. 22 is a fragmentary view of the handle portion of the tool holder shown in FIG. 20 with a fly casting rod connected to the lower end of the tool holder handle.

In FIGS. 20, 21 and 22 a somewhat modified form of the embodiment of FIGS. 1 to 9 is illustrated including a tool holder 160 having a hollow body 161 with an enlarged head 162 and a reduced handle portion 163 that is angularly related with respect to the axis of the enlarged head portion 162 for providing additional comfort at ease for the user of the tool holder, particularly when used with fishing rods. An adapter 165 is provided identical with that shown in FIGS. 1 to 9 as is the battery assembly including battery holder 166. In this embodiment an externally threaded end cap 168 is provided threadedly received in internal threads 169 on handle body portion 163 for the purpose of shifting the batteries axially into engagement with bulb 170 in the same manner as in FIGS. 1 to 9. As seen in FIG. 22, the end cap 168 may be removed and a fly rod portion segment 170 threaded into threads 169 with the extending end of the rod (not shown) inserted into adapter 165. This lengthens the effective length of the fly rod and also provides the necessary illumination for night fishing.

A casting rod 171 is shown inserted into adapter 165 in FIG. 20 and a spin casting rod handle 172 is shown inserted into holder 160 in FIG. 21.

A thumb rest 174 is shown in FIGS. 20 and 21 inserted into a recess 175 in the mating halves of the body 161 to clamp the thumb rest 174 securely in position during assembly.

We claim:

1. A lighted tool holder for releasably holding a tool, comprising; a holder body having a tool holding adapter mounted centrally therein at one end thereof, said body having a hollow projecting portion at the end opposite the tool holding adapter, a light bulb having a contact ground mounted in the body beneath the adapter, battery means having a contact and a ground in the hollow projecting body portion axially movable therein to effect electrical contact with the bulb contact, a holder for the battery means including a spring wire surrounding said battery means and providing electrical contact with the bulb contact, a holder for the battery means including a spring wire surrounding said battery means and providing electrical contact between the battery ground and the bulb ground, and an end cap threadedly engaging the hollow body portion for axially shifting the battery means into electrical contact with the light bulb.

2. A lighted tool holder for releasably holding a tool as defined in claim 1, wherein said spring wire has a spiral portion at least part of which is threadedly received by the base of the light bulb.

3. A lighted tool holder for releasably holding a tool as defined in claim 2, wherein said spring wire has a spiral portion biasing said battery means away from the bulb contact.

4. A lighted tool holder for releasably holding a tool as defined in claim 1, wherein said spring wire has a first spiral portion threadedly received by the bulb ground, a second spiral portion urging said battery means away from the light bulb contact, a third annular portion surrounding and holding said battery means, and a fourth axially extending portion engaged with the battery means ground.

5. A lighted tool holder for releasably holding a tool, comprising: a holder body, said holder body having a hollow projecting portion at one end, a lens covering the other end of the holder body, a light bulb mounted inside the hollow projecting portion, battery means and said hollow projecting portion in selectable electrical contact with said light bulb, an elongated tool holding adapter separate from the lens mounted centrally in said holder body at one end thereof above the light bulb, said adaptor having a central annular tool holding portion adjacent said other end of the holder body spaced radially from the holder body, and said adapter having a base portion with a plurality of openings therethrough to permit the passage of light from the light bulb to the lens by reflection.

6. A lighted tool holder for releasably holding a tool as defined in claim 5, wherein the holder body has a frusto-conical interior surface supporting the adapter, said adapter base having a frusto-conical outer surface fixed to the frusto-conical interior surface of the holder body.

7. A lighted tool holder for releasably holding a tool as defined in claim 5, wherein said other end of the holder body is enlarged, said lens being a substantially clear plastic cup shaped member engageable with the outer periphery of the enlarged end of the holder body to provide edge lighting.

8. A lighted tool holder for releasably holding a tool as defined in claim 5, wherein said holder body has an enlarged portion adjacent said lens, said enlarged portion having a highly reflective interior surface, said central annular tool holding portion having a highly reflective exterior surface cooperating with the reflective interior surface of the holder body to diffuse light from the light bulb through the lens.

9. A lighted tool holder for releasably holding a tool as defined in claim 5, wherein the bulb is mounted centrally in the holder body beneath the frusto-conical portion of the tool adapter, a spring wire for holding the battery means including a first spiral portion threadedly received on the light bulb, a second spiral portion urging said battery means away from the light bulb, a third annular portion surrounding and holding the battery means, and a fourth axially extending portion engagable with the battery ground to complete a circuit between the bulb and the battery means when the battery means is shifted axially into engagement with the light bulb, and means for moving the battery means axially into engagement with the light bulb.

10. A lighted tool holder for releasably holding a tool as defined in claim 5, wherein the hollow projecting portion of the holder body is angularly related to the other end of the holder body, and a finger or thumb rest on the holder body.

11. A lighted tool holder for releasably holding a tool, comprising; a holder body having an enlarged hollow end and an elongated reduced hollow projecting portion at the other end, a covering lens on said enlarged end, spaced light bulbs mounted in said enlarged end, battery means in the reduced hollow projecting portion, means for selectively electrically connecting the battery means to the light bulbs, a tool holding adapter mounted in said holder body and having a tool receiving portion adjacent to the enlarged end thereof, said adapter having spaced axially extending slots therethrough, an electrical conducting "U" shaped bracket having leg portions extending through the slots with upper portions in electrical contact with said spaced bulbs, and said bracket having a bight portion beneath the adapter engagable with the battery means to provide electrical contact between the battery means and the light bulbs.

12. A lighted tool holder for releasably holding a tool as defined in claim 11, wherein the upper portions of the "U" shaped bracket support the light bulbs.

13. A lighted tool holder for releasably holding a tool as defined in claim 11, wherein said battery means is movable axially to provide selective contact with the bight portion of the "U" shaped bracket, spring means between the tool adapter and the battery means urging them apart, and means for shifting the battery means axially into engagement with the bight portion of the bracket.

14. A lighted tool holder for releasably holding a tool as defined in claim 11, wherein the adapter includes a tubular member having a non-cylindrical opening for receiving a tool, said tubular member having external axially extending rib portions, said adapter including two mating semi-cylindrical sleeve members surrounding said tubular member and fixed thereto and to the interior of the holder body, the mating ends of the semi-cylindrical members having axial recesses defining slots for the bracket's legs.

15. A lighted tool holder for releasably holding a tool as defined in claim 10, including a removable finger or thumb rest surrounding said holder body.

* * * * *